US006143464A

United States Patent [19]

Kawauchi

[11] Patent Number: 6,143,464

[45] Date of Patent: Nov. 7, 2000

[54] POSITIVE-WORKING PHOTOSENSITIVE COMPOSITION FOR USE WITH INFRARED LASER

[75] Inventor: Ikuo Kawauchi, Shizuoka-ken, Japan

[73] Assignee: Fuji Photo Film Co., Ltd., Minami-Ashigara, Japan

[21] Appl. No.: 09/122,752

[22] Filed: Jul. 27, 1998

[30] Foreign Application Priority Data

Jul. 28, 1997 [JP] Japan ..... 9-217176

[51] Int. Cl.[7] ..... G03C 1/73

[52] U.S. Cl. ..... 430/270.1; 430/286.1

[58] Field of Search ..... 430/270.1, 271.1, 430/275.1, 281.1, 286.1, 302

[56] References Cited

U.S. PATENT DOCUMENTS

| | | | |
|---|---|---|---|
| 5,141,838 | 8/1992 | Aoshima et al. | 430/191 |
| 5,840,467 | 11/1998 | Kitatani et al. | 430/302 |
| 5,919,601 | 7/1999 | Nguyen et al. | 430/278.1 |

FOREIGN PATENT DOCUMENTS

| | | | |
|---|---|---|---|
| 285275 | 10/1995 | Japan . | |
| WO9821038 | 5/1998 | WIPO | B41C 1/10 |

OTHER PUBLICATIONS

Database WPI, Section Ch, Week 9601, Derwent Publications Ltd., Oct. 1995.

*Primary Examiner*—Janet Baxter
*Assistant Examiner*—Barbara Gilmore
*Attorney, Agent, or Firm*—Burns, Doane, Swecker & Mathis, LLP

[57] ABSTRACT

Disclosed is a positive-type photosensitive composition comprising in predetermined blending proportions a substance which generates heat upon absorbing light, a resin which has phenolic hydroxyl groups and is soluble in an aqueous alkaline solution, and a copolymer comprising 10 mol % or more of at least one of acrylic derivatives having a sulfonamide group as a component for copolymerization. The above-described composition is designed for use with an infrared laser in a direct plate making process as a composition advantageous in that the problems of insufficient image forming ability and insufficient solvent resistance of the resin, which has phenolic hydroxyl groups and is soluble in an aqueous alkaline solution, are solved, and in that the range of locations where the photosensitive composition may be handled are not limited, and further in that the sensitivity of the photosensitive composition to the concentration of the developing solution is stable, i.e., there is a broad latitude in development.

20 Claims, 1 Drawing Sheet

POSITIVE-WORKING PHOTOSENSITIVE COMPOSITION FOR USE WITH INFRARED LASER

BACKGROUND OF THE INVENTION

1. Field of the Invention

The present invention relates to an image recording material which can be used as a master in offset printing, and particularly to a positive-type photosensitive composition for an infrared laser for what is known as direct plate making in which a planographic printing plate is prepared directly based on digital signals from a computer or the like.

2. Description of the Related Art

Systems hitherto known as direct plate making systems whereby planographic printing plates are prepared directly according to digital data from a computer include (1) a system based on electrophotography, (2) a system based on photopolymerization utilizing a combination of exposure of a photosensitive material to an Ar laser and post-heating, (3) a system using a photosensitive material prepared by laminating a photosensitive material comprising a silver salt onto a photosensitive resin, (4) a system based on a silver master, and (5) a system based on the break-down of a silicone rubber layer by means of an electric discharge or laser light.

However, these systems are associated with drawbacks. That is, system (1) based on electrophotography involves complicated processes such as electrostatic charging, exposure and development together with complicated and large-scale equipment; system (2) requires a post-heating process and a plate making material which has a high sensitivity and therefore cannot be easily handled in a well-lighted room; systems (3) and (4) involve a complicated process and lead to high costs because of the use of silver salt, and system (5) has not yet been freed from the problem of residual silicone on the surface of the printing plate, although this system has reached a relatively high level in terms of degree of perfection.

In recent years, owing to the remarkable progress in laser-related technologies, solid-state lasers and semiconductor lasers, which emit rays in regions ranging from the near infrared region to the infrared region and which have a high power output power yet are nevertheless small-sized, are easily available. These lasers are very useful as a light source of exposure when a printing plate is prepared directly from digital data of a computer or the like.

A resin such as a novolac resin, which has phenolic hydroxyl groups and is soluble in an aqueous alkaline solution, is used as a polymeric compound soluble in an aqueous alkaline solution in a conventional positive-type planographic printing plate material for use with an infrared laser in a direct plate making process. For example, Japanese Patent Application Laid-Open (JP-A) No. 7-285,275 discloses an image recording material containing additives such as a resin such as a novolac resin, which has phenolic hydroxyl groups and is soluble in an aqueous alkaline solution, and a substance which generates heat upon absorbing light together with other substances such as onium salts or quinone diazide compounds. The image forming mechanism of this image recording material consists in that the onium salts or the quinone diazide compounds act as a solubility inhibitor so that the solubility of the alkali -soluble resin is substantially decreased in image portions whereas the onium salts and the quinone diazide compounds are thermally degraded and therefore do not act as a solubility inhibitor in non-image areas.

One problem of this image recording material is that it must be handled under a yellow-light lamp because the onium salts and the quinone diazide compounds absorb light of 350 to 500 nm which is within the region of visible light. Another problem arises when a printing plate prepared from this image recording material is cleaned with a solvent such as a cleaner solution so that the printing plate may be reused, because the novolac resin has a low resistance to solvent, the durability of the printing plate deteriorates if cleaner solution is used during printing.

In order to increase the durability of the printing plate, JP-A No. 7-285,275 describes an acrylic resin or a urethane resin used in an image recording material already containing onium salts or quinone diazide compounds. However, the acrylic resin or the urethane resin is not employed to function as a solubility inhibitor which decreases the solubility of the resin which has phenolic hydroxyl groups and is soluble in an aqueous alkaline solution.

SUMMARY OF THE INVENTION

Accordingly, the object of the present invention is to provide a positive-type photosensitive composition for use with an infrared laser in a direct plate making process, the composition being characterized in that the problems of insufficient image forming ability and insufficient solvent resistance of the resin, which has phenolic hydroxyl groups and is soluble in an aqueous alkaline solution, are solved, and in that the range of locations where the photosensitive composition may be handled are not limited, and further in that the sensitivity of the photosensitive composition to the concentration of the developing solution is stable, i.e., there is a broad latitude in development.

After intensive studies, the present inventors have achieved the present invention based on the discovery that the solvent resistance and the latitude in development can be markedly improved by blending the resin which has phenolic hydroxyl groups and is soluble in an aqueous alkaline solution with a specific copolymer in a proportion by weight ranging from 50:50 to 5:95.

That is, the present invention provides a positive-type photosensitive composition for use with an infrared laser, comprising a substance which generates heat upon absorbing light, a resin which has phenolic hydroxyl groups and is soluble in an aqueous alkaline solution, and a copolymer comprising 10 mol % or more of at least one of the following items (a) to (c) as a component for copolymerization:

(a) a monomer having in the molecule a sulfonamide group having at least one hydrogen atom linked to the nitrogen atom;

(b) a monomer having in the molecule an active imino group represented by the following formula;

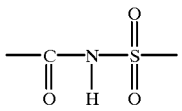

(c) an acrylamide, a methacrylamide, an acrylate, a methacrylate, or hydroxystyrene, each having a phenolic hydroxyl group;

wherein the blending ratio by weight of the resin, which has phenolic hydroxyl groups and is soluble in an aqueous alkaline solution, to the copolymer is in the range of from 50:50 to 5:95.

The present invention uses, as polymeric compounds soluble in an aqueous alkaline solution, a combination of a resin which has phenolic hydroxyl groups and is soluble in an aqueous alkaline solution and a copolymer comprising 10 mol % or more of at least one of the above-described items (a) to (c) as a component for copolymerization. Because of the strong interaction between the resin which has phenolic hydroxyl groups and is soluble in an aqueous alkaline solution and the copolymer comprising 10 mol % or more of at least one of the items (a) to (c) as a component for copolymerization, the combination of the resin and the copolymer is insoluble in an aqueous alkaline solution. When heated, however, presumably the interaction is weakened by the heat and the combination becomes soluble in an aqueous alkaline solution.

FIG. 1 illustrates a photomicrograph (by SEM) of the cross-section of a resin region in the planographic printing plate of Example 1. As is seen from this photomicrograph (by SEM), in the resin region of the planographic printing plate of the present invention, the resin, which has phenolic hydroxyl groups and is soluble in an aqueous alkaline solution, and the copolymer jointly form a sea/island structure. In the structure, the continuous phase is made up of the copolymer while the sporadic islands are made up of the resin which has phenolic hydroxyl groups and is soluble in an aqueous alkaline solution. Meanwhile, the surface layer of the planographic printing plate is made up of the resin which has phenolic hydroxyl groups and is soluble in an aqueous alkaline solution.

The planographic printing plates having the above-described sea/island structure can be obtained only when the blending ratio by weight of the resin, which has phenolic hydroxyl groups and is soluble in an aqueous alkaline solution, to the copolymer is in the range of from 50:50 to 5:95.

Consequently, according to the present invention, the resin, which has phenolic hydroxyl groups and is soluble in an aqueous alkaline solution, and the copolymer jointly form a sea/islands structure, in which the resin, which has phenolic hydroxyl groups and is soluble in an aqueous alkaline solution, is present as sporadic islands within the copolymer in such away that the resin is enveloped by the copolymer. Presumably, owing to this structure, the overall characteristics of the resin, which has phenolic hydroxyl groups and is soluble in an aqueous alkaline solution, are softened and, as a result, the solvent resistance of the resin is markedly increased.

In the present invention, since the substance which generates heat upon absorbing light has a higher affinity for the resin, which has phenolic hydroxyl groups and is soluble in an aqueous alkaline solution, than for the copolymer, the substance which generates heat upon absorbing light is localized in the surface layer of the printing plate. It is understood that the presence of the substance which generates heat upon absorbing light in the surface layer leads to a larger proportion of heat generation in the surface layer so that the generated heat is effectively used for the image formation without being absorbed in an aluminum substrate and the latitude in development is also broadened.

According to the present invention, the interaction between a novolac resin and the copolymer of the present invention decreases the solubility of the resin which is soluble in an aqueous alkaline solution in image areas so that discrimination in image formation is enhanced, thereby making it possible to form a good image. Because of this image forming mechanism, the photosensitive composition of the present invention does not need additional compounds such as onium salts and quinone diazide compounds which absorb light of 350 to 500 nm which is within the region of visible light. Since these compounds are not used, the photosensitive composition of the present invention can be used even under a white-light lamp in contrast with the disadvantage of conventional photosensitive compositions which must be used under a yellow-light lamp. Further, since the resin, which has phenolic hydroxyl groups and is soluble in an aqueous alkaline solution, and the copolymer jointly forma sea/island structure, the solvent resistance of the printing plate obtained markedly increases so that a cleaner solution as well as ink such as UV ink containing a special solvent can be used on the printing plate. Furthermore, since a higher proportion of the substance which generates heat upon absorbing light is contained in the resin, which has phenolic hydroxyl groups and is soluble in an aqueous alkaline solution, and since this resin is localized in the boundary surface layer of the image forming material, the heat is effectively used for the image formation and the latitude in development is surprisingly broadened.

DETAILED DESCRIPTION OF THE PREFERRED EMBODIMENTS

Figure 1:
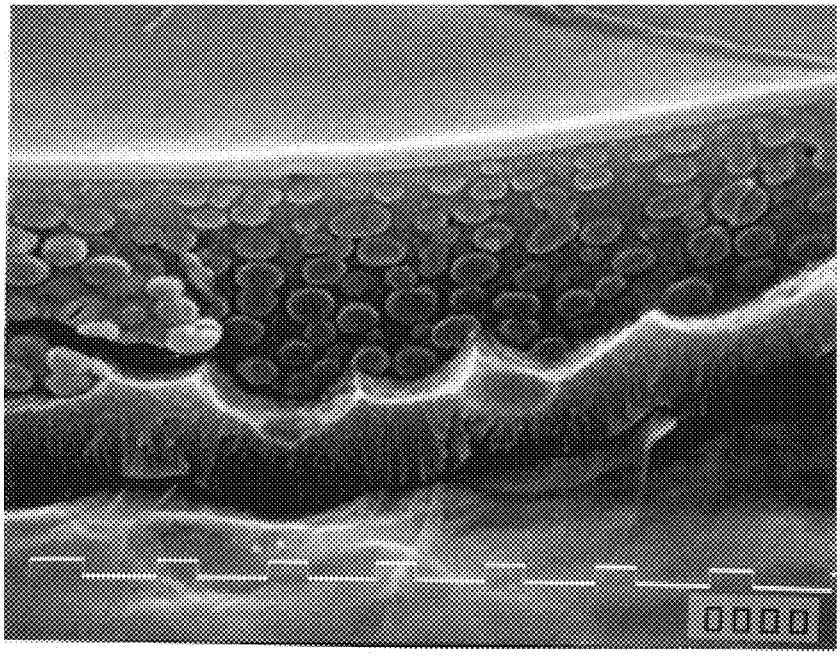
FIG. 1 is a photomicrograph (by SEM) of the cross-section of a resin portion in the planographic printing plate of Example 1.

Details of the present invention are given below.

The polymeric compounds which are soluble in an aqueous alkaline solution and used in the present invention are a resin, which has phenolic hydroxyl groups and is soluble in an aqueous alkaline solution (this resin is hereinafter referred to as "a resin having phenolic hydroxyl groups"), and a copolymer comprising 10 mol % or more of at least one of the items (a) to (c) as a component for copolymerization(this copolymer is hereinafter referred to as "a specific copolymer").

Examples of the resin having phenolic hydroxyl groups include novolac resins such as phenol/formaldehyde resins, m-cresol/formaldehyde resins, p-cresol/formaldehyde resins, m-cresol/p-cresol/formaldehyde resins, and phenol/cresol(this cresol may be m-cresol, p-cresol or a mixture of m-cresol and p-cresol)/formaldehyde resins.

The weight average molecular weight of the resin having phenolic hydroxyl groups is preferably in the range of from 500 to 20,000. The number average molecular weight is preferably in the range of from 200 to 10,000.

Further, resins, such as those described in U.S. Pat. No. 4,123,279, obtained by a condensation reaction between a formaldehyde and a phenol, having as a substituent group an alkyl group having 3 to 8 carbon atoms and exemplified by t-butylphenol and octylphenol, may be used in the present invention. In the present invention, these resins having phenolic hydroxyl groups may be used singly or in combinations of two or more.

In the present invention, the specific copolymer needs to contain 10 mol % or more, preferably 20 mol % or more, of at least one of the items (a) to (c) as a component for copolymerization. If the content is less than 10 mol %, the interaction between the specific copolymer and the resin having phenolic hydroxyl groups is so insufficient that the latitude in development is insufficient.

In addition, the specific copolymer may contain a copolymerization component other than the items (a) to (c).

The monomer corresponding to (a) is a compound which has a low molecular weight and which has in the molecule at least one sulfonamide group having at least one hydrogen atom linked to the nitrogen atom together with at least one unsaturated bond capable of polymerizing. Among this type of monomer, a particularly preferred monomer is a compound which has a low molecular weight and which has an acryloyl group, an allyl group, or vinyloxy group together with a substituted or mono-substituted aminosulfonyl group or a substituted sulfonylimino group.

Examples of these compounds include the compounds represented by the following general formulas (I) to (V).

(I)

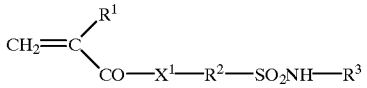

(II)

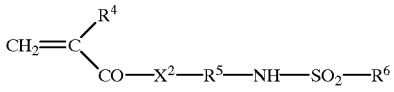

(III)

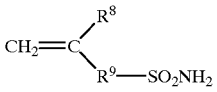

(IV)

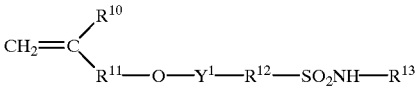

(V)

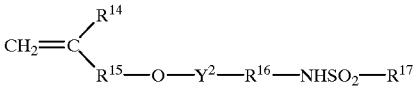

In the formulas, $X^1$and $X^2$ each represent —O— or —$NR^7$—. $R_1$ and $R_4$ each represent a hydrogen atom or —$CH_3$, $R^2$, $R^5$, $R^9$, $R^{12}$, and $R^{16}$ each represent an alkylene group, a cycloalkylene group, an arylene group, or an aralkylene group, each of which groups has 1 to 12 carbon atoms and may have a substituent. $R^3$, $R^7$, and $R^{13}$ each represent a hydrogen atom, an alkyl group, a cycloalkyl group, an aryl group, or an aralkyl group, each of which groups has 1 to 12 carbon atoms and may have a substituent. $R^6$ and $R^{17}$ each represent an alkyl group, a cycloalkyl group, an aryl group, or an aralkyl group, each of which groups has 1 to 12 carbon atoms and may have a substituent. $R^8$, $R^{10}$ and $R^{14}$ each represent a hydrogen atom or —$CH_3$. $R^{11}$ and $R^{15}$ each represent an alkylene group, a cycloalkylene group, an arylene group, or an aralkylene group, each of which groups has 1 to 12 carbon atoms and may have a single bond or a substituent. $Y^1$ and $Y^2$ each represent a single bond or —CO—.

Preferred examples of the compounds include m-aminosulfonylphenyl methacrylate, N-(p-aminosulfonylphenyl)methacrylamide, and N-(p-aminosulfonylphenyl)acrylamide.

The monomer corresponding to (b) is a compound which has a low molecular weight and which has in the molecule at least one active imino group represented by the formula given below together with at least one unsaturated bond capable of polymerizing.

Preferred examples of the compounds include N-(p-toluenesulfonyl)methacrylimide and N-(p-toluenesulfonyl) acrylimide.

The monomer corresponding to (c) is a compound composed of an acrylamide, a methacrylamide, an acrylate, a methacrylate, or hydroxystyrene, each having a phenolic hydroxyl group.

Specific examples of these compounds include N-(4-hydroxyphenyl)acrylamide, N-(4-hydroxyphenyl) methacrylamide, o-hydroxyphenyl acrylate, m-hydroxyphenyl acrylate, p-hydroxyphenyl acrylate, o-hydroxyphenyl methacrylate, m-hydroxyphenyl methacrylate, p-hydroxyphenyl methacrylate, o-hydroxystyrene, m-hydroxystyrene, and p-hydroxystyrene.

Examples of other components for copolymerization include the monomers described in the following items (1) to (12).

(1) acrylates and methacrylates each of which have an aliphatic hydroxyl group and are exemplified by 2-hydroxyethyl acrylate and 2-hydroxyethyl methacrylate (2) alkyl acrylates such as methyl acrylate, ethyl acrylate, propyl acrylate, butyl acrylate, amyl acrylate, hexyl acrylate, octyl acrylate, benzyl acrylate, 2-chloroethyl acrylate, glycidyl acrylate, and N-dimethylaminoethyl acrylate (3) alkyl methacrylates such as methyl methacrylate, ethyl methacrylate, propyl methacrylate, butyl methacrylate, amyl methacrylate, hexyl methacrylate, cyclohexyl methacrylate, benzyl methacrylate, 2-chloroethyl methacrylate, glycidyl methacrylate, and N-dimethylaminoethyl methacrylate (4) acrylamides and methacrylamides such acrylamides, methacrylamides, N-methylolacrylamide, N-ethylacrylamide, N-hexylmethacrylamide, N-cyclohexylacrylamide, N-hydroxyethylacrylamide, N-phenylacrylamide, N-nitrophenylacrylamide, and N-ethyl-N-phenylacrylamide (5) vinyl ethers such as ethyl vinyl ether, 2-chloroethyl vinyl ether, hydroxyethyl vinyl ether, propyl vinyl ether, butyl vinyl ether, octyl vinyl ether, and phenyl vinyl ether (6) vinyl esters such as vinyl acetate, vinyl chloroacetate, vinyl butylate, and vinyl benzoate (7) styrenes such as styrene, o(-methylstyrene, methylstyrene, and chloromethylstyrene (8) vinyl ketones such as methyl vinyl ketone, ethyl vinyl ketone, propyl vinyl ketone and phenyl vinyl ketone (9) olefins such as ethylene, propylene, isobutylene, butadiene, and isoprene

(10) N-vinylpyrrolidone, N-vinylcarbazole, 4-vinylpyridine, acrylonitrile, and methacrylonitrile

(11) unsaturated imides such as maleimide, N-acryloylacrylamide, N-acetylmethacrylamide, N-propionylmethacrylamide, and N-(p-chlorobenzoyl) methacrylamide

(12) unsaturated carboxylic acids such as acrylic acid, methacrylic acid, maleic anhydride, and itaconic acid In the present invention, the specific copolymer has a weight average molecular weight of preferably 2,000 or more and a number average molecular weight of preferably 1,000 or more. More preferably, the weight average molecular weight is in the range of from 5,000 to 300,000 and the number average molecular weight is in the range of from 2,000 to 250,000. The degree of dispersion (weight average molecular weight/number average molecular weight) is preferably in the range of from 1.1 to 10.

These specific copolymers may be used singly or in combinations of two or more.

It is necessary that the blending ratio by weight of the resin having phenolic hydroxyl groups to the specific copolymer be in the range of from 50:50 to 5:95. The ratio is preferably in the range of from 40:60 to 10:90.

If the proportion of the resin having phenolic hydroxyl groups exceeds the limit, properties such as solvent resistance cannot be improved because the relationship between the resin having phenolic hydroxyl groups and the specific copolymer is reversed in the sea/island structure. Conversely, if the proportion of the specific copolymer exceeds the limit, the latitude in development cannot be broadened sufficiently because the surface layer made up of the resin having phenolic hydroxyl groups is too thin.

The polymeric compounds, which are made up of the resin having phenolic hydroxyl groups and the specific copolymer, and which are soluble in an aqueous alkaline solution, may be used singly or in combinations of two or more. The amount added of the polymeric compounds soluble in an aqueous alkaline solution is in the range of from 30 to 99% by weight, more preferably in the range of from 40 to 95% by weight, and most preferably in the range of from 50 to 90% by weight based on the weight of the total solids of the material for a printing plate. If the amount added is less than 30% by weight, the durability of the recording layer is poor, whereas, if the amount added is more than 99% by weight, the sensitivity and the durability are adversely affected.

Pigments or dyes can be used as the substances which generate heat upon absorbing light in the present invention.

Pigments suitable for use in the present invention are commercially available pigments and those described in "Color Index Handbook(C.I.)", "Latest Pigment Handbook" (Saishin Ganryo Binran) edited by Japan Association of Pigment Technologies (Nihon Ganryo Gijutsu Kyokai) (1977), "Latest PigmentApplicationTechnologies" (Saishin Ganryo Oyo Gijutsu) CMC, 1986 and "Printing Ink Technologies" (Insatsu Inki Gijutsu), CMC, 1984.

Examples of the pigments include black pigments, yellow pigments, orange pigments, brown pigments, red pigments, purple pigments, blue pigments, green pigments, fluorescent pigments, metal powder pigments, and polymers containing chemically combined dyes. Specific examples of the pigments are insoluble azo pigments, azo lake pigments, condensed azo pigments, chelated azo pigments, phthalocyanine-based pigments, anthraquinone-based pigments, perylene and perinone-based pigments, thioindigo-based pigments, quinacridone-based pigments, dioxazine-based pigments, isoindolinone-based pigments, quinophthalone-based pigments, dyed lake pigments, azine pigments, nitroso pigments, nitro pigments, natural pigments, fluorescent pigments, inorganic pigments, and carbon black.

These pigments may be used without being surface-treated or may be used after being surface-treated. Possible surface treatments include a treatment in which a resin or a wax is coated on the surface of the pigment, a treatment in which a surfactant is adhered to the surface of the pigment, and a treatment in which a reactive substance (e.g., a silane coupling agent, an epoxy compound or a polyisocyanate) is bonded to the surface of the pigment. These surface-treating methods are described in "Properties and Applications of Metal Soaps" (Saiwai Shobo Co., Ltd.), "Printing Ink Technologies" (Insatsu Inki Gijutsu), CMC, 1984 and "Latest Pigment Application Technologies" (Saishin Ganryo Oyo Gijutsu), CMC, 1986.

The diameter of the pigments is preferably 0.01 to 10 $\mu$m, more preferably 0.05 to 1 $\mu$m, and most preferably 0.1 to 1 $\mu$m. If the diameter is less than 0.01 $\mu$m, the dispersion stability of the pigments in a coating liquid to form a photosensitive layer is insufficient, whereas, if the diameter is greater than 10 $\mu$m, the uniformity of the photosensitive layer after coating thereof is poor.

A known dispersing technology using a dispersing machine employed in the preparation of ink and toners can also be used for the purpose of dispersing the pigments. Examples of the dispersing machine include an ultrasonic wave dispersing machine, a sand mill, an attritor, a pearl mill, a super mill, a ball mill, an impeller, a disperser, a KD mill, a colloid mill, a dynatron, a three-roller mill, and a pressurized kneader. Details of these dispersing technologies are described in "Latest Pigment Application Technologies" (Saishin Ganryo Oyo Gijutsu), CMC, 1986.

The dyes suitable for use in the present invention are commercially available dyes and those described in, for example, "Handbook of Dyes" edited by Association of Organic Synthesis (Yuki Gosei Kagaku Kyokai) (1970). Specific examples of the dyes include azo dyes, azo dyes in the form of a metallic complex salt, pyrazolone azo dyes, anthraquinone dyes, phthalocyanine dyes, carbonium dyes, quinonimine dyes, methine dyes, and cyanine dyes.

Among these pigments and dyes, the pigments or dyes which absorb infrared light or near-infrared light are particularly preferable in the present invention, because they are suitable to use in a laser emitting infrared light or near-infrared light.

A suitable pigment which absorbs infrared light or near-infrared light is carbon black. Specific examples of dyes which absorb infrared light or near-infrared light include cyanine dyes described in, e.g., Japanese Patent Application Laid-Open (JP-A) Nos. 58-125,246, 59-84,356, 59-202,829, and 60-78,787, methine dyes described in, e.g., JP-A Nos. 58-173,696, 58-181,690, and 58-194,595, naphthoquinone dyes described in, e.g., JP-A Nos. 58-112,793, 58-224,793, 59-48,187, 59-73,996, 60-52,940 and 60-63,744, squalylium dyes described in JP-A No. 58-112,792 and cyanine dyes described in U.K. Patent No. 434,875.

Another suitable dye is the near-infrared absorbing sensitizer described in U.S. Pat. No. 5,156,938, and a substituted arylbenzo(thio)pyrylium salt described in U.S. Pat. No. 3,881,924, a trimethinethiapyrylium salt described in JP-A No. 57-142,645 (U.S. Pat. No. 4,327,169), pyrylium-based compounds described in JP-A Nos. 58-181,051, 58-220,143, 59-41,363, 59-84,248, 59-84,249, 59-146,063 and 59-146,061, a cyanine dye described in JP-A No. 59-216,146, a pentamethinethiopyrylium salt described in U.S. Pat. No. 4,283,475, and pyrylium-based compounds, Epolight III-178, Epolight III-130, Epolight III-125 and the like described in Japanese Patent Application Publication (JP-B) Nos. 5-13,514 and 5-19,702 are most preferably used.

Further examples of the preferred dyes are near-infrared absorbing dyes represented by the formulas (I) and (II) in U.S. Pat. No. 4,756,993.

The amounts added of the dye and the pigment in the material for a printing plate are each in the range of from 0.01 to 50% by weight and preferably in the range of from 0.1 to 10% by weight based on the weight of the total solids of the material for a printing plate. Most preferably, the amount added of the dye is in the range of from 0.5 to 10% by weight, while the amount added of the pigment is in the range of from 3.1 to 10% by weight based on the weight of the total solids of the material for a printing plate. If the amount added of the pigment or the dye is less than 0.01% by weight, the sensitivity of the material for a printing plate may decrease, whereas, if the amount added is more than 50% by weight, the photosensitive layer becomes nonuniform and the durability of the recording layer is poor.

The dye or the pigment may be added to the same layer together with other components, or otherwise the dye or the pigment may be added to a separate layer provided additionally. If the dye or the pigment is added to a separate layer, it is desirable that the layer to which the dye or the pigment is added be a layer adjacent to the layer containing the substance of the present invention which is thermally degradable but capable of substantially decreasing the solubility of a binder when in an undegraded state. The dye or the pigment is added preferably to a layer containing a binder resin, but may be added to a separate layer.

According to needs, a variety of additives may be incorporated into the positive-type photosensitive composition of the present invention. For example, from the standpoint of more effective inhibition of the dissolution of the image areas in a developing solution, it is desirable to incorporate the photosensitive composition with a substance, such as an onium salt, an o-quinone diazide compound, an aromatic sulfone compound, or an aromatic sulfonate compound, which is thermally degradable but capable of substantially decreasing the solubility of a polymeric compound which is soluble in an aqueous alkaline solution when in an undegraded state.

Examples of the onium salts include diazonium salts, ammonium salts, phosphonium salts, iodonium salts, sulfonium salts, selenonium salts, and arsonium salts.

Examples of preferred onium salts for use in the present invention include diazonium salts described in, e.g., S. I. Schlesinger, Photogr. Sci. Eng., 18, 387(1974), T. S. Bal et al, Polymer, 21, 423(1980) and JP-A No. 5-158,230, ammonium salts described in, e.g., U.S. Pat. Nos. 4,069,055 and 4,069,056 and JP-A No. 3-140,140, phosphonium salts described in, e.g., D. C. Necker et al, Macromolecules, 17, 2468(1984), C. S. Wen et al, Teh, Proc. Conf. Rad. Curing ASIA, p.478, Tokyo, Oct.(1988), U.S. Pat. Nos. 4,069,055 and 4,069,056, iodonium salts described in, e.g., J. V. Crivello et al, Macromolecules, 10(6), 1307(1977), Chem. & Eng. News, November 28, p.31(1988), European Patent No. 104,143, U.S. Pat. Nos. 339,049 and 410,201, JP-A No. 2-150,848 and 2-296,514, sulphonium salts described in, e.g., J. V. Crivello et al, Polymer J. 17, 73(1985), J. V. Crivello et al, J. Org. Chem., 43, 3055(1978), W. R. Watt et al, J. Polymer Sci., Polymer Chem. Ed., 22, 1789(1984), J. V. Crivello et al, Polymer Bull., 14, 279(1985), J. V. Crivello et al, Macromolecules, 14(5), 1141(1981), J. V. Crivello et al, J. Polymer Sci., Polymer Chem. Ed., 17, 2877(1979), European Patent Nos. 370,693, 233,567, 297,443 and 297,442, U.S. Pat. Nos. 4,933,377, 3,902,114, 410,201, 339,049, 4,760,013, 4,734,444 and 2,833,827, German Patent Nos. 2,904,626, 3,604,580 and 3,604,581, selenonium salts described in, e.g., J. V. Crivello et al, Macromolecules, 10(6), 1307(1977) and J. V. Crivello et al, J. Polymer Sci., Polymer Chem. Ed., 17, 1047(1979), and arsonium salts described in, e.g., C. S. Wen et al, Teh, Proc. Conf. Rad. Curing ASIA, p.478, Tokyo, Oct.(1988).

Diazonium salts are particularly preferable in the present invention. Particularly preferred diazonium salts include those described in JP-A No. 5-158,230.

Preferred quinone diazide compounds include o-quinone diazide compounds.

The o-quinone diazide compound for use in the present invention is a compound which has at least one o-quinone diazide group and increases the solubility in alkali when the compound thermally degrades. Compounds which have various structures can be used in the present invention. That is, the solubility of the photosensitive composition is increased because the thermal degradation of o-quinone diazide deprives the o-quinone diazide of the ability to inhibit the dissolution of the binder and because the o-quinone diazide itself is converted into an alkali-soluble substance by the thermal degradation. Examples of the o-quinone diazide compound for use in the present invention include the compounds described in J. Coarser, "Light-Sensitive Systems", pp.339–352, John Wiley & Sons, Inc. Among these compounds, particularly suitable compounds are sulfonates of o-quinone diazides and sulfonamides of o-quinone diazides obtained by reacting o-quinone diazides with aromatic polyhydroxy compounds or aromatic amino compounds. Also suitable are esters prepared by reacting benzoquinone-(1,2)-diazide-sulfonyl chloride or naphthoquinone-(1,2)-diazide-5-sulfonyl chloride with a pyrogallol/acetone resin as described in JP-B No. 43-28,403 and esters prepared by reacting benzoquinone-(1,2)-diazide-sulfonyl chloride or naphthoquinone-(1,2)-diazide-5-sulfonyl chloride with a phenol/formaldehyde resin as described in U.S. Pat. Nos. 3,046,120 and 3,188,210.

In addition to these compounds, also suitable are esters prepared by reacting naphthoquinone-(1,2)-diazide-4-sulfonyl chloride with a phenol/formaldehyde resin or a cresol/formaldehyde resin and esters prepared by reacting naphthoquinone-(1,2)-diazide-4-sulfonyl chloride with a pyrogallol/acetone resin. Other useful o-quinone diazide-based compounds are described in many patent documents. For example, these compounds are described in JP-A Nos. 47-5,303, 48-63,802, 48-63,803, 48-96,575, 49-38,701, and 48-13,354, JP-B Nos. 41-11,222, 45-9,610 and 49-17,481, U.S. Pat. Nos. 2,797,213, 3,454,400, 3,544,323, 3,573,917, 3,674,495, and 3,785,825, U.K. Patent Nos. 1,227,602, 1,251,345, 1,267,005, 1,329,888, and 1,330,932, and German Patent No. 854,890.

The amount added of the o-quinone diazide-based compound is in the range of from 1 to 50% by weight, more preferably in the range of from 5 to 30% by weight, and most preferably in the range of from 10 to 30% by weight based on the weight of the total solids of the material for a printing plate. These compounds may be used singly or in combinations of two or more.

Examples of the counter ions of the onium salts include tetrafluoroboric acid, hexafluorophosphoric acid, triisopropylnaphthalenesulfonic acid, 5-nitro-o-toluenesulfonic acid, 5-sulfosalicylic acid, 2,5-dimethylbenzenesulfonic acid, 2,4,6-trimethylbenzenesulfonic acid, 2-nitrobenzenesulfonic acid, 3-chlorobenzenesulfonic acid, 3-bromobenzenesulfonic acid, 2-fluorocaprylnaphthalenesulfonic acid, dodecylbenzenesulfonic acid, 1-naphthol-5-sulfonic acid, 2-methoxyl-4-hydroxy-5-benzoyl-benzenesulfonic acid, and p-toluenesulfonic acid. Among these acids, particularly suitable acids are alkyl-substituted aromatic sulfonic acids such as hexafluorophosphoric acid, triisopropylnaphthalenesulfonic acid and 2,5-dimethylbenzenesulfonic acid.

The amount added of the additives other than o-quinone diazide compounds is in the range of from 1 to 50% by weight, more preferably in the range of from 5 to 30% by weight, and most preferably in the range of from 10 to 30% by weight based on the weight of the total solids of the material for a printing plate. The additives and the binder in the present invention are preferably contained in the same layer.

In addition to these additives, a cyclic acid anhydride, a phenol, and an organic acid can also be used in order to increase the sensitivity. Examples of the cyclic acid anhydride include phthalic anhydride, tetrahydrophthalic anhydride, hexahydrophthalic anhydride, 3,6-endoxy-Δ4-tetrahydrophthalic anhydride, tetrachlorophthalic anhydride, maleic anhydride, chloromaleic anhydride, α-phenylmaleic anhydride, succinic anhydride, and pyromellitic anhydride as described in U.S. Pat. No. 4,115,128. Examples of the phenol include bisphenol A, p-nitrophenol, p-ethoxyphenol, 2,4,4'-trihydroxybenzophenone, 2,3,4-trihydroxybenzophenone, 4-hydroxybenzophenone, 4,4',40"-trihydroxytriphenylmethane, and 4,4',3",4"-tetrahydroxy-3,5,3',5'-tetramethyltriphenylmethane. Examples of the organic acid include sulfonic acids, sulfinic acids, alkylsulfuric acids, phosphonic acids, phosphates, and carboxylic acids. Specific examples of these organic acids include p-toluenesulfonic acid, dodecylbenzenesulfonic acid, p-toluenesulfinic acid, ethylsulfuric acid, phenylsulfonic acid, phenylphosphinic acid, phenyl phosphate, diphenyl phosphate, benzoic acid, isophthalic acid, adipic acid, p-toluic acid, 3,4-dimethoxybenzoic acid, phthalic acid, terephthalic acid, 4-cyclohexene-1,2-dicarboxylic acid, erucic acid, lauric acid, n-undecanoic acid, and ascorbic acid, as described in, e.g., JP-A Nos. 60-88,942 and 2-96,755.

The amount added of the cyclic acid anhydride, the phenol, and the organic acid is in the range of from 0.05 to 20% by weight, more preferably in the range of from 0.1 to 15% by weight, and most preferably in the range of from 0.1 to 10% by weight based on the weight of the total solids of the material for a printing plate.

Further, in order to broaden the stable range of processing conditions, the material for a printing plate according to the present invention may contain a nonionic surfactant as described in JP-A Nos. 62-251,740 and 3-208,514 and an amphoteric surfactant as described in JP-A Nos. 59-121,044 and 4-13,149.

Specific examples of the nonionic surfactant include sorbitan tristearate, sorbitan monopalmitate, sorbitan trioleate, stearic acid monoglyceride, and polyoxyethylene nonylphenyl ether.

Specific examples of the amphoteric surfactant include alkyldi(aminoethyl)glycine, hydrochloric acid salt of alkylpolyaminoethylglycine, 2-alkyl-N-carboxyethyl-N-hydroxyethylimidazolinium betaine, and N-tetradecyl-N,N-betaine (e.g., Amogen K manufactured by Dai-ichi Kogyo Seiyaku Co., Ltd.). The preferred amounts added of the nonionic surfactant and the amphoteric surfactant are each in the range of from 0.05 to 15% by weight, more preferably from 0.1 to 5% by weight, based on the weight of the total solids of the material for a printing plate.

In the present invention, the material for a printing plate may contain a dye or a pigment as a printing-out agent which makes it possible to produce a visible image immediately after exposure-induced heating and also as an image coloring agent.

A typical example of the printing-out agent is a combination of a compound, which releases an acid by the exposure-induced heating (i.e., a photoacid releasing agent) and an organic dye capable of forming a salt with the foregoing compound. Specific examples of the printing-out agent include a combination of o-naphthoquinonediazide-4-sulfonyl halogenide and an organic dye which forms a salt with this compound as described in JP-A Nos. 50-36,209 and 53-8,128 as well as a combination of a trihalomethyl compound and an organic dye which forms a salt with this compound as described in JP-A Nos. 53-36,223, 54-74,728, 60-3,626, 61-143,748, 61-151,644, and 63-58,440. Examples of the trihalomethyl compound are an oxazole-based compound and a triazine-based compound, both of which are effective in providing a good storability and a clear printed out image.

A dye other than the above-mentioned salt-forming organic dyes can also be used as an image coloring agent. Suitable dyes include oil-soluble dyes and basic dyes in addition to the salt-forming organic dyes. Specific examples of these dyes include Oil Yellow No. 101, Oil Yellow No. 103, Oil Pink No. 312, Oil Green BG, Oil Blue BOS, Oil Blue No. 603, Oil Black BY, Oil Black BS, and Oil Black T-505 (all manufactured by Orient Chemical Industries, Co., Ltd.), Victoria Pure Blue, Crystal Violet(C.I. 42555), Methyl Violet(C.I. 42535), Ethyl Violet(C. I . 145170B), Rhodamine B(C.I. 145170B), Malachite Green(C.I. 42000), and Methylene Blue(C.I. 52015) The dyes described in JP-A No. 62-293,247 are particularly preferable. The amount added of the dye is in the range of from 0.01 to 10% by weight and more preferably in the range of from 0.1 to 3% by weight based on the weight of the total solids of the material for a printing plate. In order to impart flexibility to the layer, a plasticizer is incorporated into the material for a printing plate of the present invention. Examples of the plasticizer include butyl phthalate, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, and an oligomer or a polymer of acrylic acid or methacrylic acid.

The image recording material of the present invention is usually formed by coating a coating liquid, which is prepared by dissolving the above-described components in a solvent, on an appropriate supporting substrate. Some illustrative nonlimiting examples of the solvent include ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylformamide, tetramethylurea, N-methylpyrrolidone, dimethyl sulfoxide, sulfolane, Y-butylolactone, and toluene. These solvents may be used singly or in a combination of two or more. The concentration of the total components (total solids including additives) in the coating liquid is preferably in the range of from 1 to 50% by weight. The coated amount (solids) after coating and drying on the supporting substrate varies according to the applications, but the desirable amount is generally in the range of from 0.5 to 5.0 g/m$^2$ in the case of a photosensitive material for a printing plate. The coating liquid can be applied by various methods. Examples of the methods include bar coating, rotational coating, spraying, curtain coating, dipping, air-knife coating, blade coating, and roll coating. As the coated amount decreases, the characteristics of the photosensitive layer becomes poor, although apparent sensitivity increases.

In order to improve the applicability, the coating liquid to form the photosensitive layer of the present invention may contain a surfactant. An example of this surfactant is a fluorine-containing surfactant described in JP-A No. 62-170,950. The preferred amount added of the surfactant is in the range of from 0.01 to 1% by weight, more preferably from 0.05 to 0.5% by weight, based on the weight of the total material for a printing plate.

A supporting substrate which is used in the present invention is a dimensionally stable plate. Specific examples of the substrate include paper, paper laminated with a plastic (e.g., polyethylene, polypropylene and polystyrene), plates of metals (such as aluminum, zinc and copper), plastic films (such as diacetylcellulose, triacetylcellulose, cellulose propionate, cellulose butyrate, cellulose butyrate acetate, cellulose nitrate, polyethylene terephthalate, polyethylene, polystyrene, polypropylene, polycarbonate, and polyvinyl acetal), and paper or plastic films laminated or vapor-deposited with the aforementioned metals.

Among these materials, a polyester film and an aluminum plate are preferable. An aluminum plate is particularly preferable, because it has a good dimension stability and is relatively economical. Examples of the aluminum plate include a pure aluminum plate and a plate of an aluminum alloy containing aluminum as a main component together with a trace of other elements. A further example of the substrate is a plastic film which is laminated or vapor-deposited with aluminum. Examples of the other elements which may be contained in the aluminum alloy include silicon, iron, manganese, copper, magnesium, chromium, zinc, bismuth, nickel, and titanium. The total content of the other elements in the aluminum alloy is 10% by weight or less. Although the aluminum particularly desirable for use in the present invention is pure aluminum, the aluminum to be used in the present invention may contain a small amount of other elements, because limitations in purification technologies make the production of perfectly pure aluminum difficult. Accordingly, the composition of the aluminum plate for use in the present invention is not particularly limited, and a conventionally known aluminum plate as a material may be used appropriately in the present invention. The thickness of the aluminum plate for use in the present invention is about 0.1 to 0.6 mm, preferably 0.15 to 0.4 mm, and most preferably 0.2 to 0.3 mm.

Prior to the surface-roughening of the aluminum plate, if necessary, a degreasing treatment is performed in order to remove any rolling oil from the surface of the aluminum plate by means of a surfactant, an organic solvent, an aqueous alkaline solution, or the like.

The surface-roughening of the aluminum plate may be performed by a variety of methods. Examples of these methods include a method in which the surface is mechanically roughened, a method in which the surface is roughened by being electrochemically dissolved, and a method in which the surface is selectively dissolved in a chemical way. The mechanical methods may be conventionally known methods such as ball abrasion, brushing, blasting and buffing. Exemplary of the electrochemical methods is electrolysis of the aluminum plate in an electrolyte solution, such as a hydrochloric acid or a nitric acid, using an a.c. current or a d.c. current. A combination of a mechanical method and an electrochemical method is also possible as described in JP-A No. 54-63,902.

If necessary, the surface-roughened aluminum plate is then subjected to an alkali-etching treatment and a neutralizing treatment. After that, if desired, the aluminum plate is subjected to an anodizing treatment so as to increase the water retention and wear resistance of the surface. A variety of electrolytes capable of producing a porous oxide layer can be used as an electrolyte for the anodizing treatment of the aluminum plate. Generally, sulfuric acid, phosphoric acid, oxalic acid, chromic acid, or a mixture of these acids is used as the electrolyte. The concentration of the electrolyte may be determined appropriately depending on the type of the electrolyte.

Conditions for the anodizing vary depending on the types of electrolyte solutions employed and cannot be stipulated unqualifiedly. However, generally employed conditions are as follows: concentration of the electrolyte solution is 1 to 80% by weight; temperature of the solution is 5 to 70° C.; current density is 5 to 60 A/dm$^2$; voltage is 1 to 10V; and duration of the electrolysis is 10 seconds to 5 minutes.

If the amount of the anodized layer is less than 1.0 g/m$^2$, the surface has poor printing durability and therefore the non-image areas of a resulting planographic printing plate are liable to form scratch marks, which collect printing ink in printing to produce so-called scratch smudge.

If necessary, the aluminum substrate whose surface is anodized may be rendered hydrophilic by a surface treatment. Examples of this hydrophilic treatment used in the present invention include treating the surface with an aqueous solution of an alkali metal silicate (such as sodium silicate) as described in U.S. Pat. Nos. 2,714,066, 3,181,461, 3,280,734, and 3,902,734, in which the supporting substrate is simply immersed or electrolytically treated in an aqueous solution of sodium silicate. Further examples are a treatment of the surface with an aqueous solution of potassium fluorozirconate as described in Japan Patent Application Publication (JP-B) No. 36-22,063 and a treatment of the surface with an aqueous solution of polyvinylsulfonic acid as described in U.S. Pat. Nos. 3,276,868, 4,153,461, and 4,689,272.

The image recording material of the present invention is prepared by forming a layer of a positive-type material for a printing plate on a supporting substrate. If necessary, a subbing layer may be formed between the foregoing layer and the substrate.

Various organic compounds may be used as components of the subbing layer. For example, an organic compound constituting the subbing layer is selected from the group consisting of carboxymethyl cellulose, dextrin, gum arabic, phosphonic acids such as 2-aminoethylphosphonic acid having an amino group, organic phosphonic acids such as phenylphosphonic acid which may have a substituent, naphthylphosphonic acid, alkylphosphonic acid, glycerophosphonic acid, methylenediphosphonic acid, and ethylenediphosphonic acid, organic phosphoric acids such as phenylphosphoric acid which may have a substituent, naphthylphosphoric acid, alkylphosphoric acid, and glycerophosphoric acid, organic phosphinic acids such as phenylphosphinic acid which may have a substituent, naphthylphosphinic acid, alkylphosphinic acid, and glycerophosphinic acid, amino acids such as glycine and β-alanine, and hydrochloric acid salts of amines having a hydroxyl group such as triethanolamine. These compounds may be used singly or may be used in a combination of two or more.

The organic subbing layer may be formed by any method described below. For example, the above-mentioned organic compound is dissolved in water, an organic solvent such as methanol, ethanol or methyl ethyl ketone, or a mixture thereof to prepare a coating solution, and thereafter the coating solution is applied to an aluminum plate to provide a subbing layer which is then dried. Alternatively, the above-mentioned organic compound is dissolved in water, an organic solvent such as methanol, ethanol or methyl ethyl ketone, or a mixture thereof to prepare a coating solution, and thereafter an aluminum plate is immersed in the coating solution so that the organic compound is adsorbed on the surface of the aluminum plate to form a subbing layer which is then water-rinsed and dried. When the former method is employed, a solution containing 0.005 to 10% by weight of the organic compound can be applied by a variety of methods. When the latter method is employed, the parameters of the conditions are as follows: concentration of the solution is 0.01 to 20% by weight and preferably 0.05 to 5% by weight; immersion temperature is 20 to 90° C. and preferably 25 to 50° C.; and immersion time is 0.1 second to 20 minutes and preferably 2 seconds to 1 minute. The pH of the coating solution may be adjusted to from 1 to 12 by use of a base such as ammonia, triethylamine or potassium hydroxide or an acid such as hydrochloric acid or phosphoric acid. Further a yellow dye maybe incorporated into the coating solution so as to improve the reproducibility of the surface characteristics of the image recording material.

The desirable coated amount of the organic subbing layer is in the range of from 2 to 200 mg/m$^2$ and preferably in the range of from 5 to 100 mg/m$^2$. If the coated amount is less than 2 mg/m$^2$, a sufficient printing durability may not be obtained. On the other hand, if the coated amount exceeds 200 mg/m$^2$, the same undesirable result may occur.

The positive-type image recording material thus obtained usually undergoes image exposure and development processes.

Examples of the light source of active rays to be used for the image exposure include mercury lamps, metal halide lamps, xeon lamps, chemical lamps, and carbon arc lamps. Examples of radiation include electron beams, X-rays, ion beams, and far-infrared rays. Further, g-rays, i-rays, deep-UV rays, and high-density energy beams (laser beams) can also be used. Examples of the laser beams include helium/neon laser, argon laser, krypton laser, helium/cadmium laser, and Kr/F excimer laser.

In the present invention, a light source emitting light in the wavelength range from near-infrared rays to far-infrared rays is preferable, and a solid-state laser or a semiconductor laser is particularly preferable.

A conventionally known aqueous alkaline solution can be used as a developing solution and also as a replenisher solution for the processing of the image recording material of the present invention. For example, the aqueous alkaline solution is an aqueous solution of an inorganic alkali salt such as sodium silicate, potassium silicate, sodium tertiary phosphate, potassium tertiary phosphate, ammonium tertiary phosphate, sodium secondary phosphate, potassium secondary phosphate, ammonium secondary phosphate, sodium carbonate, potassium carbonate, ammonium carbonate, sodium hydrogencarbonate, potassium hydrogencarbonate, ammonium hydrogencarbonate, sodium borate, potassium borate, ammonium borate, sodium hydroxide, ammonium hydroxide, potassium hydroxide, or lithium hydroxide. In addition, an organic alkaline substance can also be used for the preparation of the aqueous alkaline solution. Examples of the organic alkaline substance include monomethylamine, dimethylamine, trimethylamine, monoethylamine, diethylamine, triethylamine, monoisopropylamine, diisopropylamine, triisopropylamine, n-butylamine, monoethanolamine, diethanolamine, triethanolamine, monoisopropanolamine, diisopropanolamine, ethyleneimine, ethylenediamine, and pyridine.

These alkaline substances are used singly or in a combination of two or more.

Among these alkaline substances, a particularly preferred example of the developing solution is an aqueous solution of a silicate such as sodium silicate or potassium silicate. This is because the adjustment of developability of a developing solution is possible by varying the ratio of silicon oxide $SiO_2$ to alkali metal oxide $M_2O$, each of which constitutes the silicate, and the concentration of the silicate in the solution. For example, the use of alkali metal silicates described in JP-A No. 54-62,004 and JP-B No. 57-7,427 is effective in the present invention.

In an automated developing machine, a conventionally employed replenishing system is known to be able to process a large amount of pre-sensitized (PS) plates without exchanging the developing solution in the tank for a long period of time by feeding the tank with an aqueous solution (a replenisher solution) having an alkali strength higher than that of the developing solution in the tank. This replenishing system is also suitable for use in the present invention. If necessary, the developing solution and the replenisher solution may contain a surfactant or an organic solvent for such purposes as increasing or decreasing developability, dispersing the sludge resulting from development, and increasing the hydrophilicity of the image areas of a printing plate. Examples of preferred surfactants include anionic surfactants, cationic surfactants, nonionic surfactants, and amphoteric surfactants. Further, if necessary, the developing solution and the replenisher solution may contain a reducing agent such as hydroquinone, resorcinol, and a salt of inorganic acid, e.g., sodium or potassium sulfite and sodium or potassium hydrogensulfite, an organic carboxylic acid, a defoaming agent and an agent to convert hard water into soft water.

The printing plate after being processed with the developing solution and the replenisher solution described above is then subjected to a post-treatment such as a treatment with rinsing water, a treatment with a rinsing solution containing a surfactant or the like, or a treatment with a desensitizing solution containing gum arabic or a starch derivative. A combination of these treatments may be employed as a post-treatment when the image recording material of the present invention is used as a printing plate.

Recently, for the purpose of rationalization and standardization of plate making operations, automated developing machines have become widely used in the plate making and printing industries. Generally, the automated developing machine is made up of a developing part and a post-treating part, each comprising a device for transferring a printing plate together with tanks filled with processing solutions and spraying devices, in which the printing plate after exposure travels horizontally so that it is processed with the processing solutions which are moved up by means of pumps and sprayed from nozzles. Further, according to a new process, a printing plate is immersed in a processing tank filled with a processing solution by means of immersed guide rolls or the like. In the above-mentioned automated processing, the processing can be performed by supplying replenisher solutions to the processing solutions in accordance with processed volume and operational period of time.

Further, a so-called single-use solution system, in which a printing plate is processed with a substantially unused processing solution, can also be employed in the present invention.

Details of the use of the image recording material of the present invention as a photosensitive planographic printing plate are given below. If unnecessary image areas (e.g., film edge marks of the original film) are found on a planographic printing plate which has been obtained by a procedure comprising image exposure, developing, water-washing and/or rinsing and/or gum coating, the unnecessary image areas are erased. The erasure is preferably performed by a process comprising coating the unnecessary image areas with an erasing solution, leaving the coating to remain on the unnecessary image areas for a predetermined period of time and then removing the coating by washing with water as described in JP-B No. 2-13,293. In addition to this process, also possible is a process comprising irradiating the unnecessary image areas with active rays guided by optical fiber and then developing as described in JP-A No. 59-174,842.

A planographic printing plate thus obtained is coated with a desensitizing gum, if necessary, and can be used in a printing operation. However, if it is desired to impart a higher level of printing durability to the printing plate, the printing plate undergoes a burning treatment.

If the printing plate undergoes the burning treatment, it is desirable to treat the printing plate with a surface-adjusting solution, which is described in, e.g., JP-B Nos. 61-2,518 and 55-28,062 and JP-A Nos.62-31,859 and 61-159,655, prior to the burning treatment.

According to these treatments, the planographic printing plate is coated with a surface-adjusting solution by using sponge or absorbent cotton soaked with the solution; the planographic printing plate is immersed in a vat filled with a surface-adjusting solution; or the planographic printing plate is coated with a surface-adjusting solution by means of an automated coater. If the coated amount is homogenized by means of a squeegee device such as squeegee rollers after the coating, a better result is obtained.

The suitable coated amount of the surface-adjusting solution is generally in the range of from 0.03 to 0.8 g/m$^2$(dry weight).

The planographic printing plate after being coated with the surface-adjusting solution is dried and thereafter heated at a high temperature, if necessary, by means of a burning processor (e.g., Burning Processor BP-1300 manufactured by Fuji Film Co., Ltd.). The temperature and time vary depending on the kind of components constituting the image, but a desirable temperature and time are 180 to 300° C. and 1 to 20 minutes.

After the burning, if necessary, the planographic printing plate may be subjected to conventionally employed treatments such as water-rinsing and gum-coating. However, if the surface-adjusting solution contains a water-soluble polymeric compound or the like, a so-called desensitizing treatment such as gum-coating may be omitted.

The planographic printing plate thus prepared is mounted on an offset printing machine or the like arid is then used for printing a large number of sheets.

EXAMPLES

In order that those skilled in the art will be better able to practice the present invention, the following examples are given by way of illustration and not by way of limitation.

[Synthesis of specific copolymers]

Synthesis 1 (specific copolymer 1)

31.0 g (0.36 mol) of methacrylic acid, 39.1 g (0.36 mol) of ethyl chloroformate and 200 mL of acetonitrile were placed in a 500 mL, three-neck flask fitted with a stirrer, a condenser tube, and a dropping funnel. The resulting reaction mixture was stirred while being cooled on an ice water bath. Then, 36.4 g (0.36 mol) of triethylamine was added dropwise from the dropping funnel to the reaction mixture over a period of about one hour. Upon completing the addition, the ice water bath was removed and the reaction solution was stirred at room temperature for 30 minutes.

Next, 51.7 g (0.30 mol) of p-aminobenzenesulfonamide was added to the reaction mixture, and the reaction mixture was stirred at 70° C. on an oil bath for about one hour. After the reaction was completed, the reaction mixture was poured into 1 L of water which was being stirred, and the resulting mixture was stirred for 30 minutes. The mixture was filtered to separate a precipitated product, which was then converted into a slurry with 500 mL of water. The slurry was filtered to obtain solids, which were then dried. The dry white solid substance thus obtained was N-(p-aminosulfonylphenyl) methacrylamide (the yield was 46.9 g).

Then, 4.61 g (0.0192 mol) of N-(p-aminosulfonylphenyl) methacrylamide, 2.94 g (0.0258 mol) of ethyl methacrylate, 0.80 g (0.015 mol) of acrylonitrile and 20 g of N,N-dimethylacetamide were placed in a 20 mL, three-neck flask fitted with a stirrer, a condenser tube, and a dropping funnel. The resulting reaction mixture was stirred at 65° C. on a water bath. To the reaction mixture was added 0.15 g of V-65 (manufactured by Wako Pure Chemical Industries, Ltd.), and the reaction mixture was stirred while being kept at 65° C. for 2 hours under a nitrogen stream. Further, a mixture of 4.61 g of N-(p-aminosulfonylphenyl)methacrylamide, 2.94 g of ethyl methacrylate, 0.80 g of acrylonitrile, 20 g of N,N-dimethylacetamide and 0.15 g of V-65 was added dropwise from the dropping funnel to the reaction mixture over a period of 2 hours. Upon completing the addition, the reaction solution was stirred at 65° C. for 2 hours. After the reaction was completed, 40 g of methanol was added to the reaction mixture, and was cooled, and the mixture was poured into 2 L of water which was being stirred, and the resulting mixture was stirred for 30 minutes. The mixture was filtered to separate a precipitated product, which was then dried. In this way, 15 g of a white solid substance was obtained, and this substance was designated as specific copolymer 1. The weight average molecular weight (using polystyrene as a standard) of the specific copolymer 1 was 53,000 according to gel permeation chromatography.

Synthesis 2 (specific copolymer 2)

Specific copolymer 2 having a weight average molecular weight (using polystyrene as a standard) of 47,000 was obtained by repeating the polymerization reaction procedure of Synthesis 1, except that 4.61 g (0.0192 mol) of N-(p-aminosulfonylphenyl)methacrylamide as used therein was replaced with 3.40 g (0.0192 mol) of N-(p-hydroxyphenyl) methacrylamide.

[Preparation of supporting substrates]

A 0.3 mm thick aluminum plate (type of material: 1050) was cleaned with trichloroethylene and grained with a nylon brush using an aqueous suspension of 400 mesh pumice powder. After being well rinsed with water, the aluminum plate was etched by a process comprising the steps of immersing the aluminum plate in a 25% aqueous solution of sodium hydroxide at 45° C. for 9 seconds, rinsing the aluminum plate with water, immersing the aluminum plate in a 20% aqueous solution of nitric acid for 20 seconds and rinsing the aluminum plate with water. In the process, the etched amount of the grained aluminum plate was about 3 g/m$^2$. After the process, the aluminum plate was subjected to an anodizing process comprising immersing the aluminum plate in a 7% sulfuric acid solution as an electrolyte solution through which a d.c. current with a density of 15 A/dm$^2$ was passed. This process produced an anodized film of 3 g/m$^2$. Then, the surface-treated aluminum plate was rinsed with water and thereafter dried. The aluminum plate was then coated with the subbing composition given below, and the coating was dried at 90° C. for one minute. After drying, the coated amount was 10 mg/M$^2$.

| Subbing composition | |
|---|---|
| β-alanine | 0.5 g |
| methanol | 95 g |
| water | 5 g |

The aluminum plate which was coated as described above was treated with a 2.5% by weight aqueous solution of sodium silicate at 30° C. for 10 seconds. Further, the aluminum plate was coated with a subbing composition given below, and the coating was dried at 80C for 15 seconds. In this way, a supporting substrate was obtained. After drying, the coated amount was 15 mg/m$^2$.

| | |
|---|---|
| Subbing composition compound indicated below | 0.3 g |
| methanol | 100 g |
| water | 1 g |

-continued

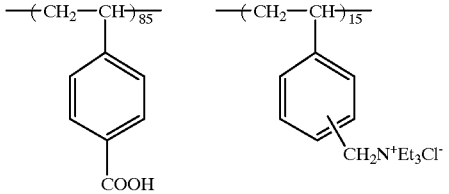

Molecular weight 28,000

Example 1

Photosensitive solution 1 having the composition given below was applied to the supporitng substrate obtained in the aforementioned procedure so that the coated weight of the photosensitive solution 1 was 1.8 g/m$^2$. In this way, a planographic original plate was prepared. Part of the resin region was peeled away from the supporting substrate, and a photomicrograph (by SEM) of the cross-section of the removed resin region was taken. Observation of the photomicrograph confirmed the formation of the sea/island structure. The photomicrograph (by SEM) of the cross-section of the resin region is shown in FIG. 1.

| Photosensitive solution 1 | in grams |
|---|---|
| specific copolymer 1 | 0.75 |
| m-cresol/p-cresol/novolac resin (m to p ratio: 6:4; weight average molecular weight: 3,500; content of unreacted cresol: 0.5% by weight) | 0.25 |
| p-toluenesulfonic acid | 0.003 |
| tetrahydrophthalic anhydride | 0.03 |
| cyanine dye A (having the structure given below) | 0.017 |
| Victoria Pure Blue BOH (anions of 1-naphthalenesulfonic acid were made the counter ions of the dye) | 0.015 |
| Megafac F-177 (fluorine-containing surfactant manufactured by Dainippon Ink and Chemicals Inc.) | 0.05 |
| γ-butyllactone | 10 |
| Methyl ethyl ketone | 10 |
| 1-methoxy-2-propanol | 1 |

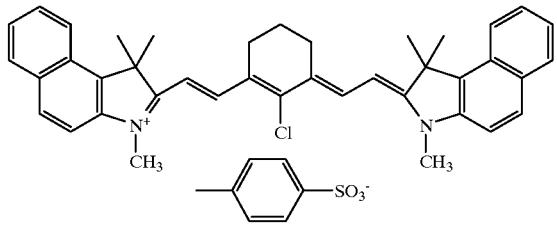

Cyanine dye A

Comparative Example 1

A planographic original plate was prepared by repeating the procedure of Example 1, except that the photosensitive solution contained 1.0 g of the specific copolymer 1 and did not contain the m-cresol/p-cresol/novolac resin. Part of the resin region was peeled away from the supporting substrate, and a photomicrograph (by SEM) of the cross-section of the removed resin region was taken. The photomicrograph did not show the formation of the sea/islands structure.

Comparative Example 2

A planographic original plate was prepared by repeating the procedure of Example 1, except that the photosensitive solution did not contain the specific copolymer 1 but contained 1.0 g of the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Comparative Example 3

A planographic original plate was prepared by repeating the procedure of Example 1, except that the photosensitive solution contained 0.45 g of the specific copolymer 1 and contained 0.55 g of the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Example 2

A planographic original plate was prepared by repeating the procedure of Example 1, except that the photosensitive solution contained 0.08 g of a substance which was a product of an esterification reaction between naphthoquinone-1,2-diazide-5-sulfonyl chloride and 2,3,4-trihydroxybenzophenone (the esterification ratio was 90%) as a substance thermally degradable but capable of substantially decreasing the solubility of a binder when in an undegraded state. Part of the resin region was peeled away from the supporting substrate, and a photomicrograph (by SEM) of the cross-section of the removed resin region was taken. The observation of the photomicrograph confirmed the formation of the sea/island structure.

Comparative Example 4

A planographic original plate was prepared by repeating the procedure of Example 2, except that the photosensitive solution as used therein contained 1.0 g of the specific copolymer 1 and did not contain the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Comparative Example 5

A planographic original plate was prepared by repeating the procedure of Example 2, except that the photosensitive solution did not contain the specific copolymer 1 but contained 1.0 g of the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Comparative Example 6

A planographic original plate was prepared by repeating the procedure of Example 2, except that the photosensitive solution contained 0.45 g of the specific copolymer 1 and contained 0.55 g of the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Example 3

Photosensitive solution 2 having the composition given below was applied to the supporting substrate obtained in the aforementioned procedure so that the coated weight of the photosensitive solution 2 was 1.8 g/m$^2$. In this way, a planographic original plate was prepared. Part of the resin region was peeled away from the supporting substrate, and a photomicrograph (by SEM) of the cross-section of the removed resin region was taken. The observation of the photomicrograph confirmed the formation of the sea/island structure.

| Photosensitive solution 2 | in grams |
|---|---|
| specific copolymer 1 | 0.4 |
| m-cresol/p-cresol/novolac resin (m to p ratio: 6:4; weight average molecular weight: 3,500; content of unreacted cresol: 0.5% by weight) | 0.6 |
| p-toluenesulfonic acid | 0.003 |
| tetrahydrophthalic anhydride | 0.03 |
| cyanine dye B (having a structure given below) | 0.017 |
| Ethyl Violet manufactured by Orient Chemical Industry, Co., Ltd. (anions of 1-naphthalenesulfonic acid were made the counter ions of the dye) | 0.015 |
| Megafac F-177 (fluorine-containing surfactant manufactured by Dainippon Ink and Chemicals Inc.) | 0.05 |
| γ-butyllactone | 10 |
| Methyl ethyl ketone | 10 |
| 1-methoxy-2-propanol | 3 |

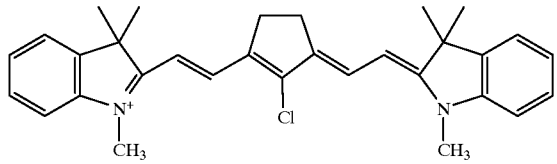

Cyanine dye B $ClO_4^-$

Comparative Example 7

A planographic original plate was prepared by repeating the procedure of Example 3, except that the photosensitive solution contained 1.0 g of the specific copolymer 1 and did not contain the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Comparative Example 8

A planographic original plate was prepared by repeating the procedure of Example 3, except that the photosensitive solution did not contain the specific copolymer 1 but contained 1.0 g of the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Comparative Example 9

A planographic original plate was prepared by repeating the procedure of Example 3, except that the photosensitive solution contained 0.40 g of the specific copolymer 1 and contained 0.60 g of the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Example 4

A planographic original plate was prepared by repeating the procedure of Example 3, except that the photosensitive solution contained 0.20 g of a substance which was a product of an esterification reaction between naphthoquinone-1,2-diazide-5-sulfonyl chloride and a pyrogallol/acetone resin (this substance is described in Example 1 of U.S. Pat. No. 3,635,709) as a substance thermally degradable but capable of substantially decreasing the solubility of a binder when in an undegraded state. Part of the resin region was peeled away from the supporting substrate, and a photomicrograph (by SEM) of the cross-section of the removed resin region was taken. The observation of the photomicrograph confirmed the formation of the sea/island structure.

Comparative Example 10

A planographic original plate was prepared by repeating the procedure of Example 4, except that the photosensitive solution contained 1.0 g of the specific copolymer 1 and did not contain the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Comparative Example 11

A planographic original plate was prepared by repeating the procedure of Example 4, except that the photosensitive solution did not contain the specific copolymer 1 but contained 1.0 g of the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Comparative Example 12

A planographic original plate was prepared by repeating the procedure of Example 4, except that the photosensitive solution contained 0.40 g of the specific copolymer 1 and contained 0.60 g of the m-cresol/p-cresol/novolac resin. Part of the resin region was peeled away from the supporting substrate, and a photomicrograph (by SEM) of the cross-section of the removed resin region was taken. The photomicrograph did not show the formation of the sea/island structure.

Example 5

Photosensitive solution 3 having the composition given below was applied to the supporting substrate obtained in the aforementioned procedure so that the coated weight of the photosensitive solution 3 was 1.8 g/m . In this way, a planographic original plate was prepared. Part of the resin region was peeled away from the supporting substrate, and a photomicrograph (by SEM) of the cross-section of the removed resin region was taken. The observation of the photomicrograph confirmed the formation of the sea/island structure.

| Photosensitive solution 3 | in grams |
|---|---|
| specific copolymer 2 | 0.9 |
| phenol/formaldehyde novolac resin (weight average molecular weight: 11,000; content of unreacted phenol: 0.5% by weight) | 0.1 |
| p-toluenesulfonic acid | 0.003 |
| tetrahydrophthalic anhydride | 0.03 |
| cyanine dye B | 0.028 |
| Victoria Pure Blue BOH (anions of 1-naphthalenesulfonic acid were made the counter ions of the dye) | 0.015 |
| Megafac F-177 (fluorine-containing surfactant manufactured by Dainippon Ink and Chemicals Inc.) | 0.05 |
| γ-butyllactone | 10 |
| Methyl ethyl ketone | 5 |
| 1-methoxy-2-propanol | 5 |

Comparative Example 13

A planographic original plate was prepared by repeating the procedure of Example 5, except that the photosensitive solution contained 1.0 g of the specific copolymer 2 and did not contain the phenol/formaldehyde novolac resin. Part of the resin region was peeled away from the supporting substrate, and a photomicrograph (by SEM) of the cross-section of the removed resin region was taken. The photomicrograph did not show the formation of the sea/island structure.

Comparative Example 14

A planographic original plate was prepared by repeating the procedure of Example 5, except that the photosensitive solution did not contain the specific copolymer 2 but contained 1.0 g of the phenol/formaldehyde novolac resin. Part of resin the region was peeled away from the supporting substrate, and a photomicrograph (by SEM) of the cross-section of the removed resin region was taken. The photomicrograph did not show the formation of the sea/island structure.

Comparative Example 15

A planographic original plate was prepared by repeating the procedure of Example 5, except that the photosensitive solution contained 0.40 g of the specific copolymer 2 and contained 0.60 g of the phenol/formaldehyde novolac resin. Part of the resin region was peeled away from the supporting substrate, and a photomicrograph (by SEM) of the cross-section of the removed resin region was taken. The photomicrograph did not show the formation of the sea/island structure.

Example 6

A planographic original plate was prepared by repeating the procedure of Example 5, except that the photosensitive solution contained 0.26 g of 2,5-dibutoxy-4-morpholinobenzenediazonium hexafluorophosphate as a substance thermally degradable but capable of substantially decreasing the solubility of a binder when in an undegraded state. Part of the resin region was peeled away from the supporting substrate, and a photomicrograph (by SEM) of the cross-section of the removed resin region was taken. The observation of the photomicrograph confirmed the formation of the sea/island structure.

Comparative Example 16

A planographic original plate was prepared by repeating the procedure of Example 6, except that the photosensitive solution contained 0.96 g of the specific copolymer 2 and contained 0.04 g of the phenol/formaldehyde novolac resin. Part of the resin region was peeled away from the supporting substrate, and a photomicrograph (by SEM) of the cross-section of the removed resin region was taken. The photomicrograph did not show the formation of the sea/island structure.

Comparative Example 17

A planographic original plate was prepared by repeating the procedure of Example 6, except that the photosensitive solution did not contain the specific copolymer 2 but contained 1.0 g of the phenol/formaldehyde novolac resin. Part of the resin region was peeled away from the supporting substrate, and a photomicrograph (by SEM) of the cross-section of the removed resin region was taken. The photomicrograph did not show the formation of the sea/island structure.

Comparative Example 18

A planographic original plate was prepared by repeating the procedure of Example 6, except that the photosensitive solution contained 0.40 g of the specific copolymer 2 and contained 0.60 g of the phenol/formaldehyde novolac resin. Part of the resin region was peeled away from the supporting substrate, and a photomicrograph (by SEM) of the cross-section of the removed resin region was taken. The photomicrograph did not show the formation of the sea/island structure.

[Evaluation of the planographic original plates]

The planographic original plates obtained above were subjected to the following tests to evaluate the performances. Test results are shown in Table 1.

(Latitude in development)

The planographic original plates were exposed to a semiconductor laser having an output power of 500 mW, a wavelength of 830 nm and a beam diameter of 17 $\mu$m ($1/e^2$) at a main scanning speed of 5 m/second. The exposed plates were processed by using an automated developing machine (PS Processor 900 VR manufactured by Fuji Film Co., Ltd.) fed with a developing solution DP-4 and a rinsing solution FR-3 (1:7), each manufactured by Fuji Film Co., Ltd. In this test, two dilution levels were employed when diluting DP-4 with water, namely, a 1:6 dilution level and a 1:8 dilution level. For each of the two dilution levels, the amount of exposure required for image formation was measured. A planographic original plate which exhibits a smaller difference between the two amounts of exposure is adjudged to have a better latitude in development. A difference of 20 mJ/cm$^2$ or less means practicability.

(Stability under a white-light lamp)

The planographic original plates were placed at a distance of 400 1× under a daylight fluorescent lamp (Mitsubishi Neolumisuper FLR40SW50EDL-MNU manufactured by Mitsubishi Electric Corp.) for 5 minutes. The planographic original plates were then exposed to the same semiconductor laser as above, and thereafter processed by using a developing solution DP-4 (1:8) manufactured by Fuji Film Co., Ltd. In this test, amounts of exposure required for image formation were measured. A planographic original plate which requires a smaller amount of exposure is adjudged to be less liable to cause change in characteristics under a white-light lamp. A value of 20 mJ/cm$^2$ or less means practicability.

(Printing Durability)

Fine paper was printed by using planographic printing plates which were processed with DP-4 (1:8) and mounted on Hidel KOR-D manufactured by Heidelberg Corp. During printing, the printing plate surface was wiped with a cleaning solution (Plate Cleaner CL2 manufactured by Fuji Film Co., Ltd.) for every 5,000 printed sheets. Table 1 lists maximum numbers of printed sheets before the occurrence of plate wearing, which is a defect indicative of partial absence of ink on the plate surface because of the wear of the photosensitive layer of the planographic printing plate.

TABLE 1

| | Sensitivity | | | Latitude in | Change in characteristics under a white-light lamp | Number of |
|---|---|---|---|---|---|---|
| | DP-4(1:8) | | | | (Before | printed |
| | Before exposure | After exposure | DP-4(1:6) | development (1:8)–(1:6) | exposure)–(After exposure) | sheets (10,000) |
| Example 1 | 160 mJ/cm$^2$ | 160 | 140 | 20 | 0 | 5.5 |
| Comparative Example 1 | 170 | 170 | 110 | 60 | 0 | 5.5 |
| Comparative Example 2 | 160 | 160 | 140 | 20 | 0 | 2.0 |
| Comparative Example 3 | 160 | 160 | 120 | 40 | 0 | 3.5 |
| Example 2 | 150 mJ/cm$^2$ | 90 | 140 | 10 | 60 | 6.0 |
| Comparative Example 4 | 170 | 100 | 120 | 50 | 70 | 6.0 |
| Comparative Example 5 | 150 | 80 | 140 | 10 | 70 | 2.5 |
| Comparative Example 6 | 160 | 90 | 120 | 40 | 70 | 3.5 |
| Example 3 | 160 | 160 | 140 | 20 | 0 | 5.0 |
| Comparative Exampie 7 | 180 | 180 | 110 | 70 | 0 | 5.0 |
| Comparative Example 8 | 160 | 160 | 140 | 20 | 0 | 1.5 |
| Comparative Example 9 | 170 | 170 | 120 | 50 | 0 | 2.5 |
| Example 4 | 160 | 100 | 140 | 20 | 60 | 5.5 |
| Comparative Example 10 | 180 | 100 | 120 | 60 | 80 | 5.5 |
| Comparative Example 11 | 160 | 100 | 140 | 20 | 60 | 2.0 |
| Comparative Example 12 | 160 | 90 | 120 | 40 | 70 | 3.0 |
| Example 5 | 160 | 160 | 150 | 10 | 0 | 5.5 |
| Comparative Example 13 | 180 | 180 | 100 | 80 | 0 | 5.5 |
| Comparative Example 14 | 160 | 160 | 140 | 20 | 0 | 2.0 |
| Comparative Example 15 | 160 | 160 | 110 | 50 | 0 | 3.0 |
| Example 6 | 160 | 100 | 150 | 10 | 60 | 5.5 |
| Comparative Example 16 | 180 | 100 | 120 | 60 | 80 | 5.5 |
| Comparative Exampie 17 | 160 | 90 | 150 | 10 | 70 | 2.0 |
| Comparative Example 18 | 160 | 90 | 120 | 40 | 70 | 3.0 |

As seen in Table 1, the planographic printing plates of the present invention are excellent both in latitude in development and in wear resistance. A broader latitude in development and a higher resistance to wear can be obtained when the photosensitive layer contains a substance which is thermally degradable but capable of substantially decreasing the solubility of a binder when in an undegraded state. Planographic original plates have a lesser tendency to change characteristics under a white-light lamp when the photosensitive layer does not contain the substance which is thermally degradable but capable of substantially decreasing the solubility of a binder when in an undegraded state. The latitude in development is insufficient when the specific copolymers are used singly. On the other hand, the wear resistance of the printing plates is poor when resins having phenolic hydroxyl groups are used singly. If the blending ratio of a resin having phenolic hydroxyl groups to a specific copolymer is not appropriate, both the latitude in development and the wear resistance are insufficient. A correlation can be seen between the performance exhibited by the printing plates and the sea/island structure.

According to the present invention, the interaction between the novolac resin and the copolymer of the present invention leads to a higher strength of the image areas and makes it possible to form better images. Because of this, the photosensitive layer does not need to contain a substance, such as an onium salt or a quinone diazide compound, which has a light absorption region (350 to 500 nm) in a visible light region. As a result, the planographic original plate of the present invention can be used under a white-light lamp, and it is not limited to use under a yellow-light lamp.

The sea/island structure created by the resin which has phenolic hydroxyl groups and is soluble in an aqueous alkaline solution together with the copolymer enables the latitude in development to surprisingly broaden and to markedly improve the solvent resistance of the printing plate so that a cleaner solution and ink, such as UV ink, containing a special solvent can be used on the printing plate. Further, the planographic original plate exhibits a high heat-absorbing efficiency, because the resin, which has phenolic hydroxyl groups and is soluble in an aqueous alkaline solution, is localized on the surface as the boundary face of the image forming material and because this resin is rich in the substance which generates heat upon absorbing light.

As stated above, the present invention makes it possible to provide an image recording material which has good recordability and wear resistance and which can be used in conventional processors and printing machines and which can be used in a direct plate making process according to digital data from a computer or the like.

What is claimed is:

1. A positive-type photosensitive composition for use with an infrared laser, comprising a substance which generates heat upon absorbing light, a resin which has phenolic hydroxyl groups and is soluble in an aqueous alkaline solution, and a copolymer comprising 10 mol % or more of at least one of the following items (a) to (c) as a component for copolymerization:

(a) a monomer having in the molecule a sulfonamide group having at least one hydrogen atom linked to the nitrogen atom;

(b) a monomer having in the molecule an active imino group represented by the following formula:

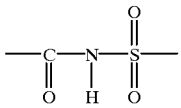

(c) an acrylamide, a methacrylamide, an acrylate, a methacrylate, or hydroxystyrene, each having a phenolic hydroxyl group;

wherein the blending ratio by weight of said resin which has phenolic hydroxyl groups and is soluble in an aqueous alkaline solution to said copolymer is in the range of from 50:50 to 5:95. and wherein said composition is free of onium salts and quinone diazide compounds.

2. A positive-type photosensitive composition for use with an infrared laser according to claim 1, wherein said copolymer comprises 20 mol % or more of at least one of the items (a) to (c) as a component for copolymerization.

3. A positive-type photosensitive composition for use with an infrared laser according to claim 1, wherein said component (a) for copolymerization is a compound which has at least one group selected from the group consisting of an acryloyl group, an allyl group, and a vinyloxy group together with at least one group selected from the group consisting of a di-substituted aminosulfonyl group, a mono-substituted aminosulfonyl group, and a substituted sulfonylimino group.

4. A positive-type photosensitive composition for use with an infrared laser according to claim 1, wherein said component (b) for copolymerization is a compound which has said active imino group together with an unsaturated group capable of polymerizing.

5. A positive-type photosensitive composition for use with an infrared laser according to claim 1, wherein the blending ratio by weight of said resin which has phenolic hydroxyl groups and is soluble in an aqueous alkaline solution to said copolymer is in the range of from 40:60 to 10:90.

6. A positive-type photosensitive composition for use with an infrared laser according to claim 1, wherein the sum of the amount added of said resin which has phenolic hydroxyl groups and is soluble in an aqueous alkaline solution and the amount added of said copolymer is in the range of from 30 to 99% by weight based on the weight of the total solids of the material for a printing plate in the positive-type photosensitive composition.

7. A positive-type image recording material for use with an infrared laser, comprising a supporting substrate having a photosensitive layer formed thereon including at least a substance which generates heat upon absorbing light, a resin which has phenolic hydroxyl groups and is soluble in an aqueous alkaline solution, and a copolymer comprising 10 mol % or more of at least one of the following items (a) to (c) as a component for copolymerization:

(a) a monomer having in the molecule a sulfonamide group having at least one hydrogen atom linked to the nitrogen atom;

(b) a monomer having in the molecule an active imino group represented by the following formula:

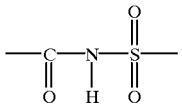

(c) an acrylamide, a methacrylamide, an acrylate, a methacrylate, or hydroxystyrene, each having a phenolic hydroxyl group;

wherein said resin which has phenolic hydroxyl groups and is soluble in an aqueous alkaline solution and said copolymer jointly form a sea/island structure in such a way that said copolymer forms a continuous layer in said photosensitive layer, and wherein said resin which has phenolic hydroxyl groups and is soluble in an aqueous alkaline solution is localized in the surface region of said photosensitive layer, wherein said photosensitive layer is free of onium salts and quinone diazide compounds.

8. A positive-type image recording material for use with an infrared laser according to claim 7, wherein the blending ratio by weight of said resin which has phenolic hydroxyl groups and is soluble in an aqueous alkaline solution to said copolymer is in the range of from 50:50 to 5:95.

9. A positive-type image recording material for use with an infrared laser according to claim 7, wherein said copolymer comprises 20 mol % or more of at least one of said items (a) to (c) as a component for copolymerization.

10. A positive-type image recording material for use with an infrared laser according to claim 7, wherein said component (a) for copolymerization is a compound which has at least one group selected from the group consisting of an acryloyl group, an allyl group, and a vinyloxy group together with at least one group selected from the group consisting of a di-substituted aminosulfonyl group, a mono-substituted aminosulfonyl group, and a substituted sulfonylimino group.

11. A positive-type image recording material for use with an infrared laser according to claim 7, wherein said component (b) for copolymerization is a compound which has said active imino group together with an unsaturated group capable of polymerizing.

12. A positive-type image recording material for use with an infrared laser according to claim 7, wherein the blending ratio by weight of said resin which has phenolic hydroxyl groups and is soluble in an aqueous alkaline solution to said copolymer is in the range of from 40:60 to 10:90.

13. A positive-type image recording material for use with an infrared laser according to claim 7, wherein the sum of the amount added of said resin which has phenolic hydroxyl groups and is soluble in an aqueous alkaline solution and the amount added of said copolymer is in the range of from 30 to 99% by weight based on the weight of the total solids of the material for a printing plate in said photosensitive layer.

14. A positive-type planographic original plate for use with an infrared laser, comprising a supporting substrate having a photosensitive layer formed thereon including at least a substance which generates heat upon absorbing light, a resin which has phenolic hydroxyl groups and is soluble in an aqueous alkaline solution, and a copolymer comprising 10 mol % or more of at least one of the following items (a) to (c) as a component for copolymerization:

(a) a monomer having in the molecule a sulfonamide group having at least one hydrogen atom linked to the nitrogen atom;

(b) a monomer having in the molecule an active imino group represented by the following formula:

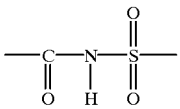

(c) an acrylamide, a methacrylamide, an acrylate, a methacrylate, or hydroxystyrene, each having a phenolic hydroxyl group;

wherein said resin which has phenolic hydroxyl groups and is soluble in an aqueous alkaline solution and said copolymer jointly form a sea/island structure in such a way that said copolymer forms a continuous layer in said photosensitive layer, and wherein said resin which has phenolic hydroxyl groups and is soluble in an aqueous alkaline solution is localized in the surface region of said photosensitive layer, and wherein said photosensitive layer is free of onium salts and quinone diazide compounds.

15. A positive-type planographic original plate for use with an infrared laser according to claim 14, wherein the blending ratio by weight of said resin which has phenolic hydroxyl groups and is soluble in an aqueous alkaline solution to said copolymer is in the range of from 50:50 to 5:95.

16. A positive-type planographic original plate for use with an infrared laser according to claim 14, wherein said copolymer comprises 20 mol % or more of at least one of the items (a) to (c) as a component for copolymerization.

17. A positive-type planographic original plate for use with an infrared laser according to claim 14, wherein said component (a) for copolymerization is a compound which has at least one group selected from the group consisting of an acryloyl group, an allyl group, and a vinyloxy group together with at least one group selected from the group consisting of a di-substituted aminosulfonyl group, a mono-substituted aminosulfonyl group, and a substituted sulfonylimino group.

18. A positive-type planographic original plate for use with an infrared laser according to claim 14, wherein said component (b) for copolymerization is a compound which has said active imino group together with an unsaturated group capable of polymerizing.

19. A positive-type planographic original plate for use with an infrared laser according to claim 14, wherein the blending ratio by weight of said resin which has phenolic hydroxyl groups and is soluble in an aqueous alkaline solution to said copolymer is in the range of from 40:60 to 10:90.

20. A positive-type planographic original plate for use with an infrared laser according to claim 14, wherein the sum of the amount added of said resin which has phenolic hydroxyl groups and is soluble in an aqueous alkaline solution and the amount added of said copolymer is in the range of from 30 to 99% by weight based on the weight of the total solids of the material for a printing plate in said photosensitive layer.

* * * * *